US005791974A

United States Patent [19]

Sakcriska

[11] Patent Number: 5,791,974

[45] Date of Patent: Aug. 11, 1998

[54] DEVICE AND METHOD FOR CONTOURING ICE SKATE BLADES

[76] Inventor: Glenn Sakcriska, 108 Maple St., Ypsilanti, Mich. 48195

[21] Appl. No.: 795,369

[22] Filed: Feb. 4, 1997

[51] Int. Cl.[6] ..... B24B 1/00

[52] U.S. Cl. ..... 451/45; 451/5

[58] Field of Search ..... 451/45, 5, 185, 451/192, 205, 224, 383, 913; 76/82, 89.1, 89.2

[56] References Cited

U.S. PATENT DOCUMENTS

| | | | |
|---|---|---|---|
| 4,403,455 | 9/1983 | Chiasson | 451/383 |
| 5,009,039 | 4/1991 | Lager et al. | 451/383 |
| 5,195,277 | 3/1993 | Courchesne | 451/45 |
| 5,547,416 | 8/1996 | Timms | 451/45 |

*Primary Examiner*—Robert A. Rose
*Assistant Examiner*—George Nguyen
*Attorney, Agent, or Firm*—Barbara M. Burns

[57] ABSTRACT

A device and a method for contouring an ice skate blade. The method comprises the steps of measuring the overall length of the soleplate of the boot and calculating the center point of the soleplate, transferring the center point of the soleplate to the blade and marking the center point of the soleplate onto the blade as the first calibration point. A second and third calibration point, calculated as 25% of the soleplate length are marked from the first calibration point towards the toe and towards the heel of the blade. Toe and heel radius termination points are also marked. The device comprises a measuring tool for measuring the length of the soleplate and having calibration points and radii termination points preset on the device according to the soleplate length. The device therefore eliminates the calculation of all the calibration points and radii termination points each time an ice skate blade is to be contoured. The blade depths at the second and third calibration points are measured and the needed pitching is determined. The blade is ground based on the calibration points with some adjustments for the skate wearer's physique and skill level.

13 Claims, 3 Drawing Sheets

DEVICE AND METHOD FOR CONTOURING ICE SKATE BLADES

BACKGROUND OF THE INVENTION

The field of the invention pertains to ice skates. In particular, the invention pertains to a method for contouring the blade of an ice skate prior to sharpening the blade. In the past, contouring the blade has been accomplished by measuring the length of the blade or the boot, and grinding radii based on the center of the blade length or of the boot length.

However, the effect of a grinding a radius based on the center of the blade length or boot length causes difficulty because the length of the blade or the boot may not correlate to the physique of the wearer or to the purpose to be made of the ice skate. Thus, no known method exists to contour a skate and provide accurate positioning of radii on the blade to facilitate the wearer's ease and effectiveness of movement.

SUMMARY OF THE INVENTION

It is to a device and an improved method for contouring an ice skate blade to which the present invention is directed. Cam templates are employed to direct a cut for a specific radius on the main or work center radius curve of the blade. Other radii are imparted to the blade as will discussed hereinbelow. After the blade is contoured, the skate blade is then sharpened as is generally known.

Essentially, the invention comprises measuring the soleplate of the skate boot to which the blade is attached and using the soleplate length as the basis for calculating the necessary contouring. The soleplate length closely approximates the foot of the skate wearer. The soleplate length is halved and transferred to the blade and thereon marked as the first calibration point. Second and third calibration points are calculated as 25% each of the soleplate length and are respectively marked on the blade towards the toe and towards the heel from the first calibration point. Toe and heel radii termination points are also marked on the blade.

A measuring device having the various soleplate lengths and their collateral calibration points and radii termination points pre-marked thereon is useful for marking the blade. The use of the device obviates the calculation each time of the collateral measurements.

The blade is measured for depth at the second and third calibration points. The depth can be the distance from the edge of the blade to the top of the blade if the blade is exposed, or to the plastic blade support of some skates. An understanding of different skate manufacturers is extremely helpful here to know how much of the blade the manufacturer embeds in the plastic support.

A comparison is made between the blade depth at the second calibration point and the third calibration point, thereby indicating the amount the blade needs to be pitched. The depth is generally less at the second calibration point, achieving the pitching of the blade. A gap is created at the second calibration point when compared with the third calibration point. A one-half millimeter gap at the front calibration point is usually appropriate for the skate of a defenseman. A one millimeter gap is appropriate for the skate of a forward while a larger gap up to one and one-half millimeters is useful for the skate of a novice or child skater.

Pitching the blade shifts the apex of the blade. This accomplishes a decrease in the angle of the back of the boot to the surface of the ice, which is normally 90 degrees. Therefore, the Achilles tendon of the skater is stretched allowing increased knee bend and improved balance, stability and skating power.

Some skates have blades that are substantially longer than the soleplate of the skate boot, i.e., speed skates. Although, most skates have blades that are only somewhat longer than the soleplate of the skate boot, the relevant point is that the blade is longer than the soleplate.

By employing the length of the soleplate rather than the length of the blade, a more accurate determination can be made of the wearer's weight distribution. By basing the contouring on the soleplate length, better contouring to fit the skate wearer can be achieved. Other factors pertaining to the wearer and the use to be made of the skates are also addressed. An analysis of the wearer's physique helps determine how the skate blade should be contoured, including which radius should be imparted to the blade for the work center radius curve.

A case in point is a knock kneed skate wearer, who requires a lesser radius on the main or work center radius curve, whereas a novice or young skater needs the work center radius curve to be greater. A skate wearer having "tight thighs" or inner thighs that are close together as opposed to an open thigh stance, needs a lesser work center radius curve.

Additionally, by varying the overall length of the work center radius curve, differences of each individual skate wearer can be accommodated. A skate wearer who has a large foot in proportion to the body should have the front radius curve extended further into the work center radius curve than the average skate wearer.

The purpose for which the skate is to be used also impacts the contouring of the skate. For instance, a hockey defenseman's skate is desired to have a rounder radius than a hockey goalie's skate, which should have a flatter or larger radius.

It is envisioned that the method can be used with a variety of skate contouring and grinding devices. An advantage of this new method is that when using known skate grinding fixtures, the skate blade is clamped at the first calibration point, thereby holding the skate more securely during the contour grinding and sharpening procedures. Hence, creating less give or flex and consequently, more consistent sharpening results. Moreover, the method as herein described can be programmed into an automatic machine such as a Computer Numerical Controlled grinding machine for consistent and repeatable contouring results.

For a more complete understanding of the present invention, reference is made to the following detailed description when read with in conjunction with the accompanying drawings wherein like reference characters refer to like elements throughout the several views, in which:

DESCRIPTION OF THE PREFERRED EMBODIMENT

Figure 2:
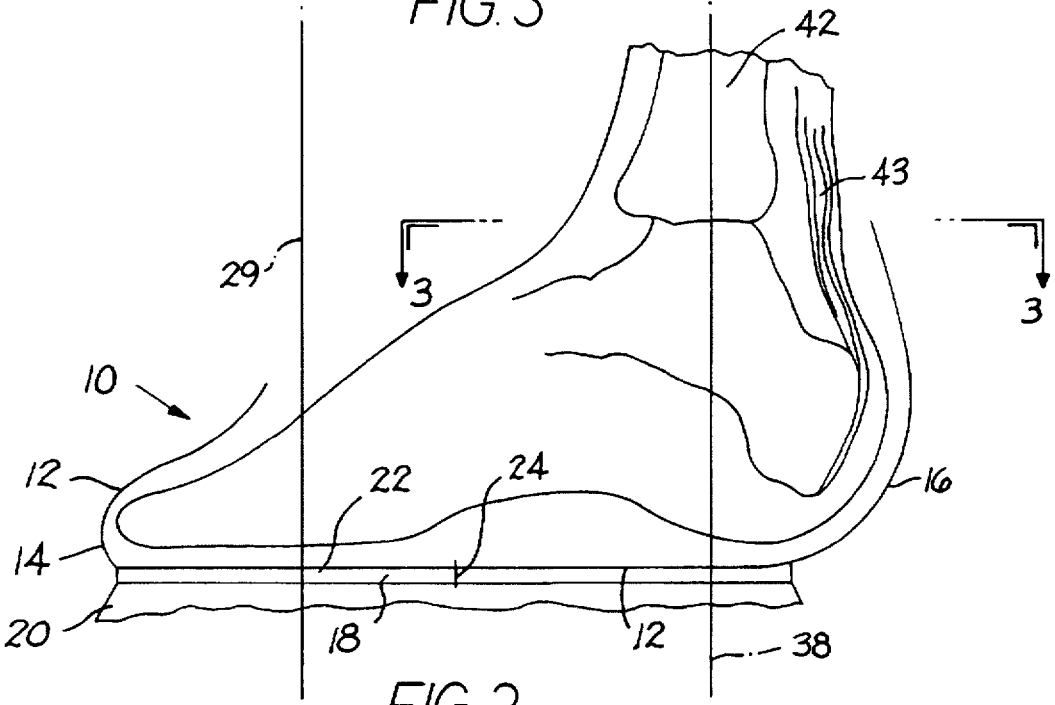
FIG. 2 illustrates a cutaway side view of the skate wearer's foot in the skate boot, with the center line of the pivot axis from the skate wearer's tibia extending to intersect the blade.
Figure 1:
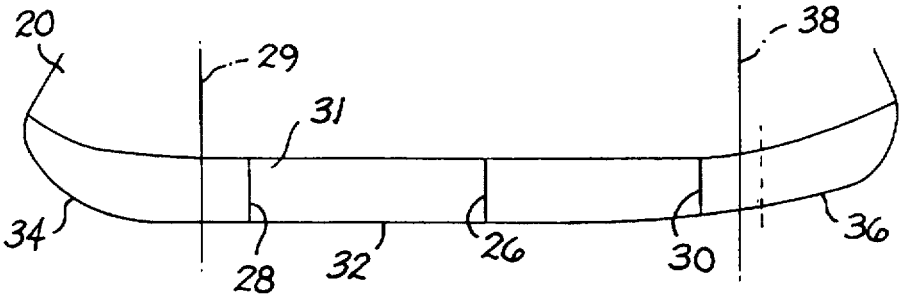
FIG. 1 illustrates a side view of invention according to the invention showing the marking of the center point of the soleplate onto the blade as the first calibration point.

In FIGS. 1 and 2, an ice skate generally denoted as 10 is thereshown. The ice skate 10 comprises a boot 12 having a toe 14 and a heel 16 with a soleplate 18 affixed to the underside of the boot 12. Extending from the soleplate 18 is an ice skate blade 20.

Figure 5B:
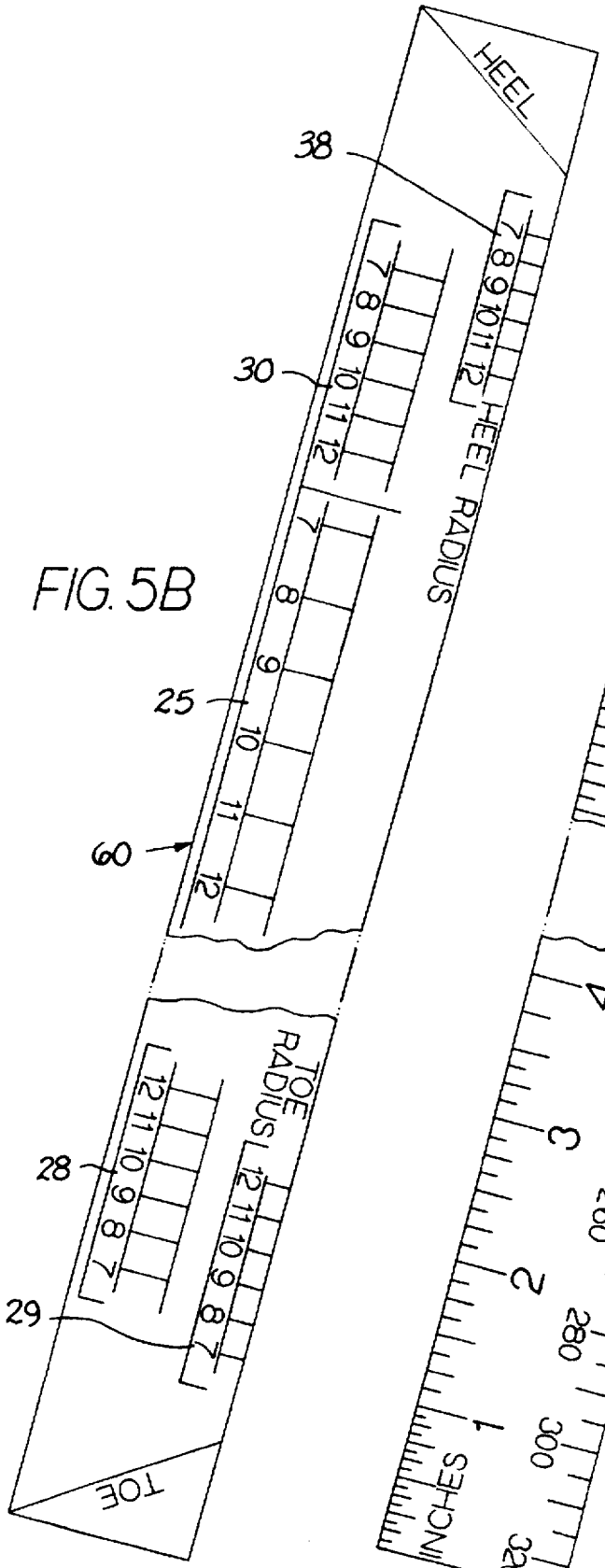
FIG. 5B illustrates the reverse side of the device with the precalculated indicators and calibration points.
Figure 5A:
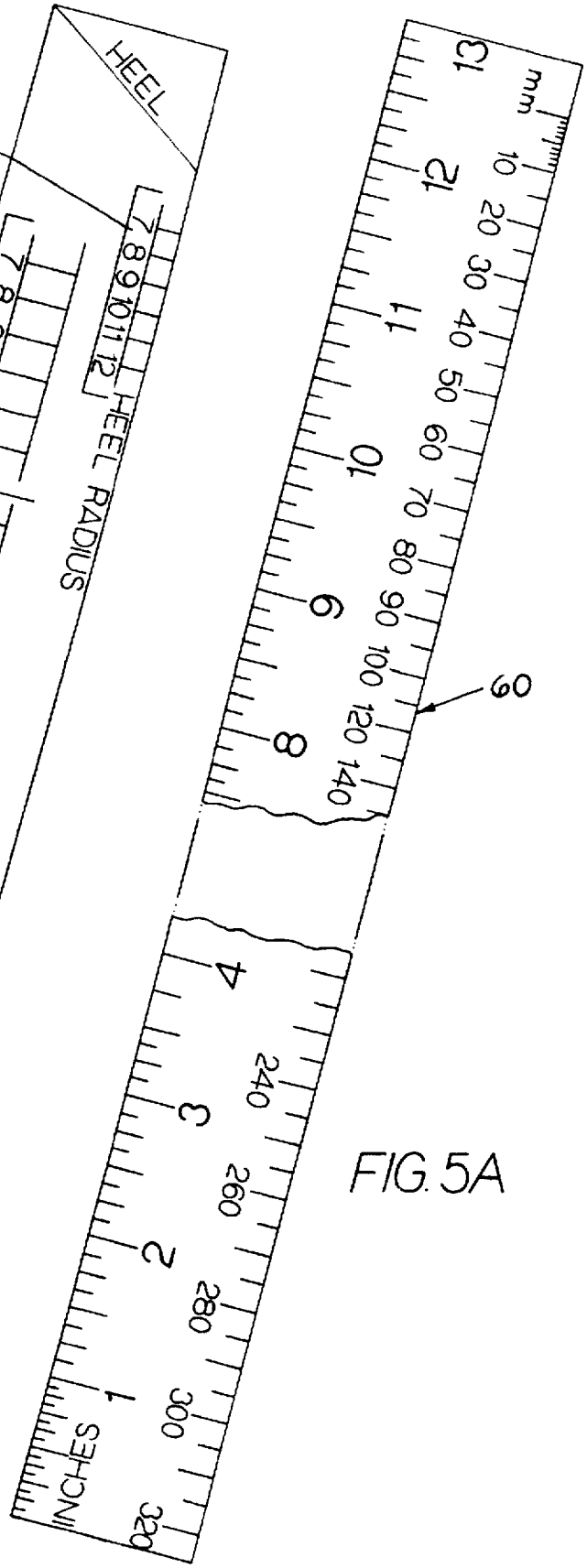
FIG. 5A illustrates the device that is used for measuring the soleplate.

The soleplate 18 has an overall distance or length 22 from near the toe 14 of the boot 12 to near the heel 16 of the boot 12. The overall distance or length 22 of the soleplate 18 is divided in half, denoting the center point 24 of the soleplate 18. The device 60 as depicted in FIG. 5A can be used to measure the soleplate length 22.

The center point 24 of the soleplate 18 is transferred perpendicularly to the blade 20 and is marked onto the blade 20 as the first calibration point 26. On the device 60 (FIG. 5B) an indicator 25 signifies the center point 24 for the respective soleplate length. Therefrom the first calibration point 26, additional calibration points are individually calculated and marked or simply marked without requiring calculation by using the device 60. The device 60 has the second 28 and third 30 calibration points and the toe 29 and the heel 38 radii points pre-calculated for the various soleplate lengths. Thus, the need for calculation and the potential for error is reduced. Moreover, the time needed to contour an ice skate blade is reduced.

A second calibration point 28 is calculated as 25% of the soleplate length 22 and the second calibration point 28 is marked onto the blade 20 at the calculated distance from the first calibration point 26 towards the toe 14 end of the blade 20.

Similarly, a third calibration point 30 is calculated as 25% of the soleplate length 22 and is also marked onto the blade 20 at the calculated distance from the first calibration point 26 but towards the heel 16 end of the blade 20. The calibration points 28, 30 can be slashed or made with a different color ink to identify the calibration points. A toe radius point 29 and a heel radius point 38 are also marked. The blade depth 31 as was discussed hereinabove is then measured at the second 28 and third 30 calibration points. A determination of the needed amount of pitching of the blade is made based on the variation between the blade depths at the second and third calibration points. Alternately, the pitching can be created by increasing or decreasing the variation (by widening or narrowing the gap at the second calibration point).

Hereafter, a first radius curve, the work center radius curve 32 is ground onto the blade 20 and is centered around the first calibration point 26. The work center radius curve 32 is a specific known radius, although the work center radius curve 32 can be flattened or tightened by altering the radius as was discussed above. The work center radius curve 32 extends between at least the second calibration point 28 and the third calibration point 30 and can extend further on the blade 20.

After the work center radius curve 32 has been ground, or during the grinding, the blade 20 is pitched towards the toe 14 and a second radius curve is ground. A toe radius point 29 at which in the wearer's foot the metatarsus head meets the phalange is extended to the blade 20. The second radius curve, the front radius curve 34 is ground from the toe 14 towards the work center radius curve 32 with the front radius curve 34 being blended into the work center radius curve 32. The front radius curve 34 is ground approximately 20 to 24% of the length of the soleplate. The front radius curve 34 can extend past the toe radius point 29 and to the second calibration point 28 into the work center radius curve 32. For certain physiques of the skate wearer, it is desirable to extend the front radius curve 34 closer to the work center radius curve 32.

Figure 3:
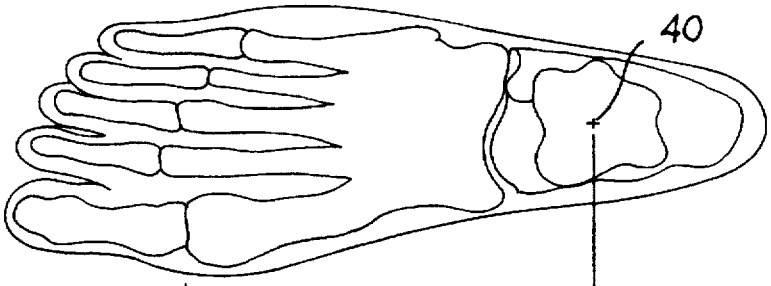
FIG. 3 illustrates a cross sectional view of the skate wearer's foot according to the sectional lines 3—3 of FIG. 2 showing the apex point of the tibia.

Thereafter, a third radius curve, the back radius curve 36 is ground from the heel end 16 of the blade 20 towards the work center radius curve 32. The back radius curve 36 terminates and does not extend into the work center radius curve 32 beyond the center line 38 of the pivot axis 40 extending from the wearer's tibia 42 as is shown in FIGS. 2 and 3. The Achilles' tendon 43 of the wearer is shown in FIG. 2. The center line 38 corresponds to the heel radius point 31. The back radius curve 36 is generally maintained at 18% of the overall length of the soleplate 18.

Figure 4:
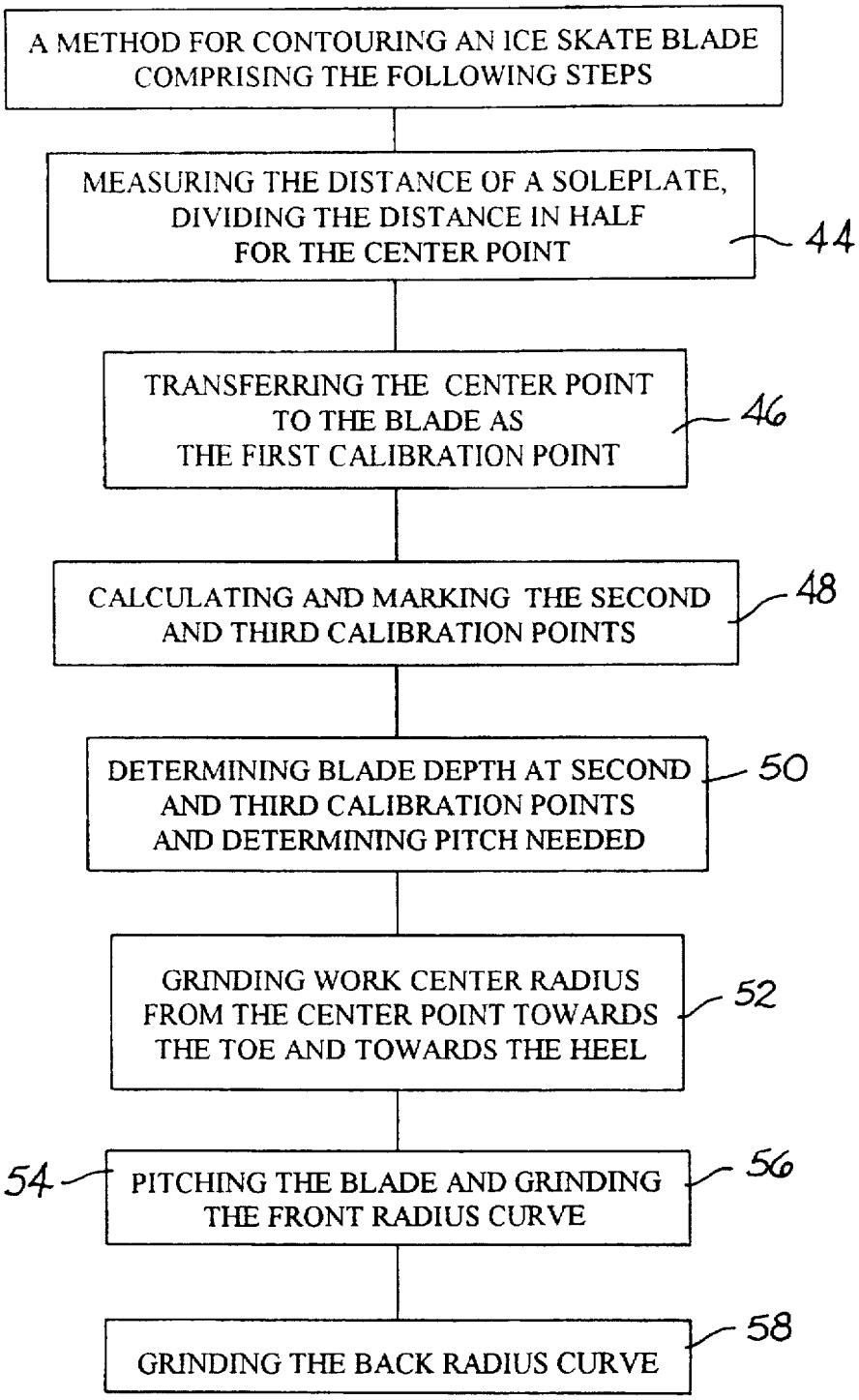
FIG. 4 illustrates a flow diagram of the steps involved in the method.

Now turning to FIG. 4, the steps of the method of the invention are thereshown and described as follows.

The first step 44 is measuring the distance of the soleplate and dividing the distance in half thereby giving a center point of the soleplate.

The next step 46 is transferring the center point of the soleplate to and then marking the center point of the soleplate onto the blade as the first calibration point. The first calibration point is then used as the basis from which to mark 48 the second and third calibration points, calculated as discussed above. The toe radius termination point and the heel radius termination point are also marked.

The next step 50 is determining and comparing the variation of the blade depth at the second and third calibration points to ascertain the amount of pitching to be accomplished.

The next step is grinding 52 the first, specific, known radius, the work center radius curve from the center of the blade towards the toe and also towards the heel.

The next step is pitching the blade 54 and then grinding 56 the front radius curve comprising approximately 20 to 24% of the overall length of the soleplate.

Thereafter, the next step is grinding 58 the back radius curve, with the length of the back radius curve comprising 16 to 20% of the overall length of the soleplate. Part of this step is limiting the back radius curve from extending past the centerline or the apex of the tibia, which center line corresponds to the heel radius termination point.

Having described my invention, many modifications thereto will become apparent to those skilled in the art to which it pertains without deviation from the spirit of the invention as defined in the appended claims.

I claim:

1. A method for contouring an ice skate blade of an ice skate, the ice skate having a soleplate, the ice skate blade having a toe, a heel, and a center portion disposed between the toe and the heel, the method comprising the following steps measuring the overall length of the soleplate of the ice skate, calculating the center point of the soleplate and transferring the center point of the soleplate to the blade, marking the center point of the soleplate on the skate blade as a first calibration point, calculating a second and third calibration points as 25% of the overall length of the soleplate, marking the second calibration point on the blade from the first calibration point towards the toe of the blade, marking the second calibration point on the blade from the first calibration point towards the heel of the blade, marking a toe radius point closer to the toe than to the second calibration point;

marking a heel radius point closer to the heel than to the third calibration point;

measuring the depth of the blade at the second calibration point and at the third calibration point, determining the pitch requirement of the blade from the variation in blade depth at the second and third calibration points, grinding a first radius curve, the work center radius curve about the first calibration point towards the toe and towards the heel, the work center radius curve having a specific radius, pitching the blade towards the toe, grinding a second radius curve, the front radius curve on the blade from the toe towards the work center radius curve, and grinding a third radius curve, the back radius curve from the heel of the blade towards the work center radius curve.

2. The method for contouring an ice skate blade according to claim 1 wherein the length of the back radius curve comprises between 16 to 20% of the overall length of the blade.

3. The method for contouring an ice skate blade according to claim 1 wherein a wearer of the ice skate having a pivot axis extending from the wearer's tibia to the wearer's heel, the pivot axis having a centerline and the back radius curve being ground to engage the work center radius curve before intersecting the centerline of the pivot axis and before intersecting the third calibration point.

4. The method for contouring an ice skate blade according to claim 1 wherein the length of the front radius curve comprises 20 to 24% of the overall length of the blade.

5. The method for contouring an ice skate blade according to claim 1 wherein a wearer of the ice skate having a point on the wearer's foot where the metatarsus head meets the phalange, the point being extended to the blade as the toe radius point, the front radius curve being ground to engage the work center radius at one of the toe radius point and a point between the toe radius point and the first calibration point.

6. The method for contouring an ice skate blade according to claim 1 wherein the size of an ice skate boot being large as compared to the body of a skater normally wearing that size of ice skate boot, the front radius curve being extended further into the work center radius curve.

7. The method for contouring an ice skate blade according to claim 1 wherein the work center radius curve has greater than the specific radius for a novice skater.

8. The method for contouring an ice skate blade according to claim 1 wherein the work center radius has greater than the specific radius for a skate wearer having thighs close together.

9. The method for contouring an ice skate blade according to claim 1 wherein the work center radius has less than the specific radius for a skate wearer having a knock kneed condition.

10. The method for contouring an ice skate blade according to claim 1 wherein the depth of the blade is measurable from the soleplate to the lower edge of the blade.

11. The method for contouring an ice skate blade according to claim 1 wherein the depth of the blade is measurable from a support of the blade to the lower edge of the blade.

12. The method for contouring an ice skate blade according to claim 1 wherein the depth of the blade is measurable from the top of an unsupported blade to the lower edge of the blade.

13. The method for contouring an ice skate blade according to claim 1 wherein the method is programmable into an automatically controlled grinding machine.

* * * * *